US005961475A

United States Patent [19]

Guitay

[11] Patent Number: 5,961,475

[45] Date of Patent: Oct. 5, 1999

[54] MASSAGE APPARATUS WITH SUCKING AND MOBILISING ACTION ON SKIN TISSUE

[75] Inventor: Louis-Paul Guitay, Monteleger, France

[73] Assignee: LPG Systems, France

[21] Appl. No.: 09/051,570

[22] PCT Filed: Jul. 24, 1997

[86] PCT No.: PCT/FR97/01388

§ 371 Date: Apr. 8, 1998

§ 102(e) Date: Apr. 8, 1998

[87] PCT Pub. No.: WO98/06371

PCT Pub. Date: Feb. 19, 1998

[30] Foreign Application Priority Data

Aug. 9, 1996 [FR] France ..... 96/10237

[51] Int. Cl.[6] ..... A61H 07/00

[52] U.S. Cl. ..... 601/7; 601/6; 601/8; 601/126

[58] Field of Search ..... 601/7, 6, 8, 9, 601/10, 11, 12, 13, 14, 123, 126, 133, 134; 600/583, 575

[56] References Cited

U.S. PATENT DOCUMENTS

| | | | |
|---|---|---|---|
| 1,460,927 | 7/1923 | Thompson et al. | 601/6 |
| 2,123,418 | 7/1938 | Crosley et al. | 601/12 |
| 2,574,601 | 11/1951 | Swanson . | |
| 3,297,024 | 1/1967 | Robinson . | |
| 4,729,368 | 3/1988 | Guitay | 601/123 |
| 4,883,047 | 11/1989 | Guitay | 601/6 |
| 5,062,413 | 11/1991 | Bullard | 601/162 |

FOREIGN PATENT DOCUMENTS

| | | | |
|---|---|---|---|
| 0224422 | of 1987 | European Pat. Off. . | |
| 0284527 | of 1991 | European Pat. Off. . | |
| 409202 | of 1909 | France . | |
| 901787 | of 1945 | France . | |
| 1225094 | of 1959 | France . | |
| 1501054 | 11/1967 | France | 601/6 |
| 1590131 | of 1970 | France . | |
| 251124 | 9/1912 | Germany | 601/6 |
| 303154 | 1/1918 | Germany | 601/6 |
| 168279 | of 1934 | Switzerland . | |
| 206851 | 11/1939 | Switzerland | 601/6 |
| 9509596 | of 1995 | WIPO . | |
| 9603959 | of 1996 | WIPO . | |

*Primary Examiner*—Danton D. DeMille
*Assistant Examiner*—Justine R. Yu
*Attorney, Agent, or Firm*—Wall, Marjama, Bilinski & Burr

[57] ABSTRACT

A massage device that includes a casing having a pair of opposed transverse walls and side walls to define an open bottom chamber. The bottom of the transverse walls having convex edges extending the length of the opening. At least one of the transverse walls being capable of moving toward and away from the opposing transverse wall and a suction device is arranged to draw air through the chamber and thus draw skin into said chamber when the device is applied to a patient's body.

9 Claims, 4 Drawing Sheets

MASSAGE APPARATUS WITH SUCKING AND MOBILISING ACTION ON SKIN TISSUE

The present invention relates to an improved apparatus making it possible, in simple and efficient fashion, to perform massaging operations, both on human beings and on animals (horses, cattle, etc.).

Various massage techniques are used, depending on the treatments to be performed, but it can be stated that they all involve exerting forces on the patient which resort to pressure and/or movement and/or pinching phenomena.

A great number of types of apparatus have to date been proposed in order to facilitate the masseur's work.

Among the various solutions which have been proposed, it has firstly been envisaged to use apparatus resorting to a simple mechanical action, for example using assemblies including small or large balls mounted on a support casing, making it possible, if appropriate, to dispense a treatment product (cream, liquid) as disclosed, particularly by FR-A-1 225,094.

It has furthermore been proposed as disclosed by FR-A-901,787, to produce massage apparatus which consist of a treatment head connected to a suction circuit, the said treatment head consisting of a casing which includes an inner chamber into which a suction circuit opens. This casing is in the form of a bell which is open at its base and whose lower edge is generally of a rounded shape. When the apparatus is applied to the patient's body, a skin fold is formed inside the bell, which fold bears directly against the peripheral edge of the latter.

A simply designed apparatus of this type is relatively difficult to employ, is difficult to move over the patient's body and exerts simply a "sucker" action.

Numerous other solutions, as disclosed by CH-A-168, 279, U.S. Pat. No. 2,574,601, U.S. Pat. No. 3,297,024, FR-A-409,202, FR-A-1,590,131, have proposed to combine, with a suction phenomenon, a mechanical action exerted by the rollers or balls which make it possible to exert on the body an action of pressure and/or movement and/or friction by vibration.

The solutions proposed in these documents lead to complex assemblies which are difficult to employ and are not fully satisfactory.

Various types of massage apparatus have more recently been proposed, making it possible to perform, in simple and efficient fashion, massages of the "touching-rolling" type, allowing a continuous action to be exerted on the patient which causes not only localized pinching but also progressive movement of the pinched region, so as to cause "rolling", all this while pressure is being exerted. Apparatus of this type have, in particular, formed the subject-matter of EP-A-224,422 and 284,527 (corresponding respectively to U.S. Pat. No. 4 729,368 and U.S. Pat. No. 4 883,047), as well as WO 9603959. The disclosure contained in U.S. Pat. No. 4,729,368 is incorporated herein by reference.

In general, the apparatus described in the aforementioned documents include, mounted in casing which can be actuated by hand, two parallel rollers, preferably having a smooth surface, mounted freely or driven positively in rotation inside the casing. The rollers may be mounted on the casing either with fixed inter-axial distance or so that they can move apart from one another and back together again automatically during the massage operation. The casing is connected to suction means via a conduit whose end opens into the space contained between the rollers, which therefore allows a pressure reduction to be created between them when they are applied to the patient's body, so as to form a skin fold bearing against the surfaces of the rollers.

SUMMARY OF THE INVENTION

However, a solution has been found, and it is this which forms the subject of the present invention, which in a manner similar to the teachings of FR-A-901,787, makes it possible to perform massage by simple suction inside a chamber whose lower edges are convexly shaped, the suction forming a skin fold directly against the said edges of the chamber and which furthermore makes it possible to perform a massage of the "squeezing-rolling" type, as in the aforementioned apparatus making it possible to perform this type of massage, without having to resort to rotary elements in the form of rollers, the apparatus according to the invention enhancing the efficiency of the treatment by the fact that a frictional action is exerted on the surface of the skin fold which is formed, in addition to intermittent pinching of the latter.

Furthermore, the apparatus according to the invention is very compact, very simply designed, and easy to maintain. It has a structure such that, in spite of its compactness, it makes it possible to take up a skin fold having a very large surface area.

Lastly, it has been observed that, when used, it was particularly easy to move over the patient's body.

Furthermore, according to a preferred embodiment, an apparatus of this type can be used equally well by exerting thrust or tension, and with the same efficiency in both directions.

As mentioned above, the apparatus according to the invention is advantageously designed for exerting a pulsating action on the skin fold. An action of this type can be obtained, for example, by mounting the said apparatus at the inlet of a suction circuit including means making it possible to vary the air flow rate. For example, a circuit of this type may include a solenoid valve produced in accordance with the teachings of patent WO 95/09596, which makes it possible to obtain not only all-or-nothing operation, but also a controlled flow rate of the air stream between two determined values, with the possibility of adjustment between the said values.

A solenoid valve of this type therefore makes it possible to obtain "sequential, pulsed, rhythmic" operation such that, during the massage operation, the suction rate varies cyclically, thus causing an "vibration" effect, of variation of the suction force and of the take-up of the skin, thus improving the efficiency of the treatment and also making it easier to employ.

In general, the invention therefore relates to a massage apparatus consisting, as described in FR-A-901,787 of a treatment head proper connected to a suction circuit, the said treatment head comprising a casing including an inner chamber into which the suction circuit opens, and in which the skin fold formed under the effect of the suction when the apparatus is applied to the patient bears directly against the convexly shaped lower edges of the said chamber.

The apparatus according to the invention is characterized in that the chamber which is open at its base forms a window delimited by two side walls and two transverse walls, the skin fold formed under the effect of the suction bearing at least against the lower edges of the transverse walls, the said edges having the shape of convex surfaces of opposite curvature; the active surfaces consisting of the lower edges of the transverse walls can have a movement imparted to them, making it possible to vary their spacing between two predetermined positions.

In the rest of the description, the lower edges of the transverse walls, which define the suction chamber and against which the skin fold bears, are denoted by the expression "active surfaces".

The variation of the spacing of the active surfaces between two predetermined positions can be obtained either by moving one of its surfaces with respect to the other, which remains fixed, or preferably by moving both surfaces simultaneously.

According to a preferred embodiment, the transverse walls consist of one or two partitions fitted into the body proper of the casing.

By moving two walls towards one another, an apparatus of this type allows a novel mechanical massage to be performed in a simple fashion.

In a first embodiment, according to which only one of the transverse walls is active, this wall consists of a partition articulated about a pin arranged in the upper part inside the casing and parallel to the window; it is held normally away from the wall opposite it, which wall is fixed, under the action of thrust means (springs), and its pivoting is obtained under the effect of the vacuum and/or the pressure difference between the pressure inside the chamber and the external pressure, which is equal to atmospheric pressure.

In the rest of the description, for the sake of simplicity, it will simply be indicated that the pivoting is obtained under the effect of the suction.

According to a preferred embodiment in accordance with the invention, the transverse walls consist of two partitions fitted into the casing and articulated about two pins which are arranged symmetrically with respect to a plane median to the lower window. In such a case, the two articulated partitions are mounted on a flat spring which tends to keep them away from one another, bearing against the body of the casing. This flat spring extends over the entire width of the chamber of the treatment head and, when the two walls tend to move towards one another under the action of the suction, it makes it possible to ensure that the interior of the treatment chamber remains sealed in spite of the pivoting of the walls.

The casing of an apparatus according to the invention is preferably produced by moulding and is essentially composed of a central body which defines a chamber which is open to the outside, the side walls being, for their part, formed by two flanges fitted on either side of the central body and fixed thereto by any suitable means, such as screws. The side walls may, if appropriate, be transparent, thus making it possible to see the skin fold formed inside the chamber during the treatment.

Advantageously, the side flanges serve as guide elements for the mobile wall(s) and thrust means may be incorporated therein in order to keep the active surfaces normally away from one another, they being brought towards one another simply under the effect of the suction.

BRIEF DESCRIPTION OF THE DRAWINGS

The invention and the advantages which it affords will, nevertheless, be understood more clearly by virtue of the two illustrative embodiments given below by way of example, but without implying any limitation, these embodiments being illustrated by the appended diagrams, in which.

DESCRIPTION OF THE INVENTION

Figure 1:
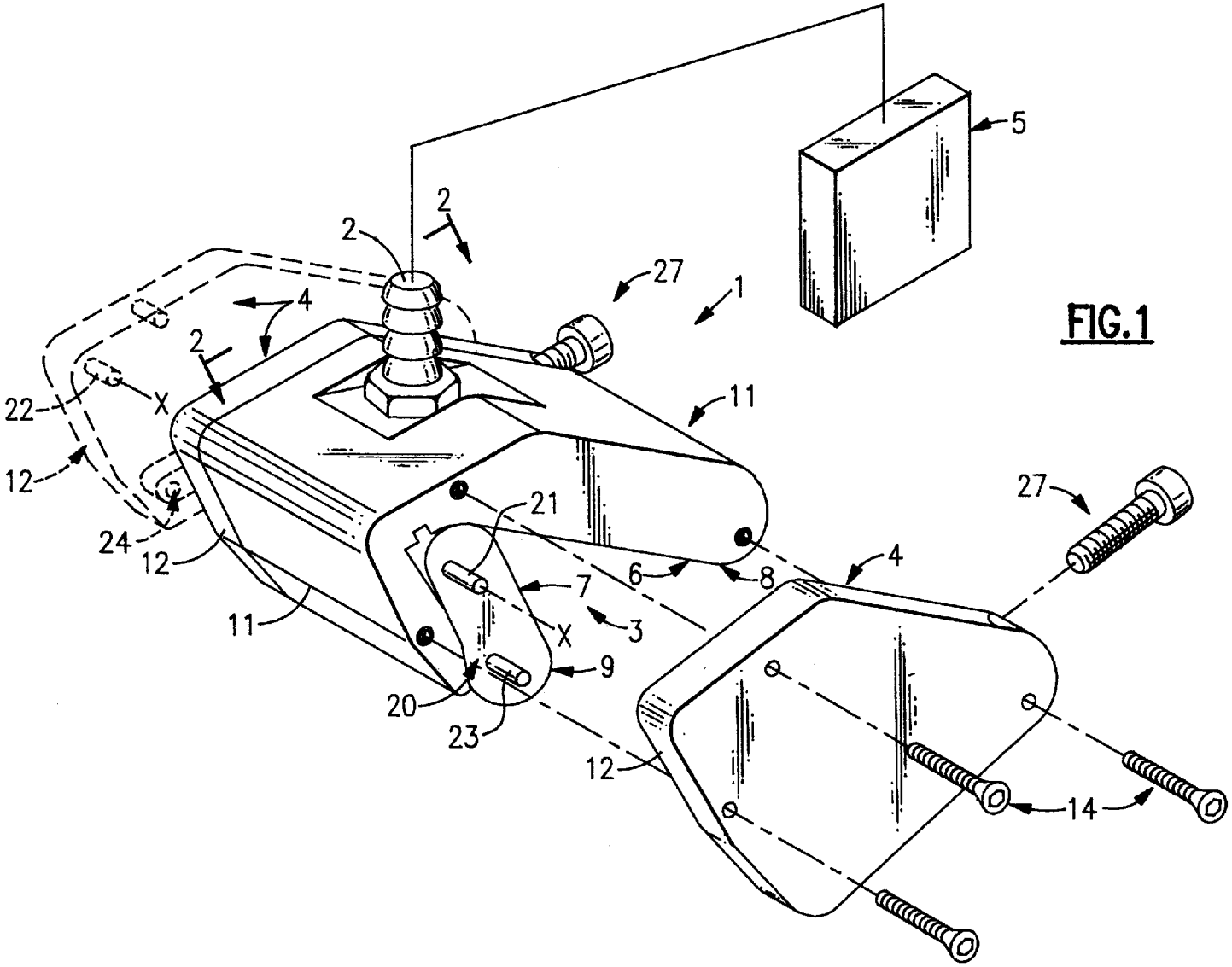
FIG. 1 is a schematic exploded perspective view of an apparatus according to the invention, in which the separation between the active surfaces during the treatment is varied by moving a single active surface relative to the other.
Figure 3:
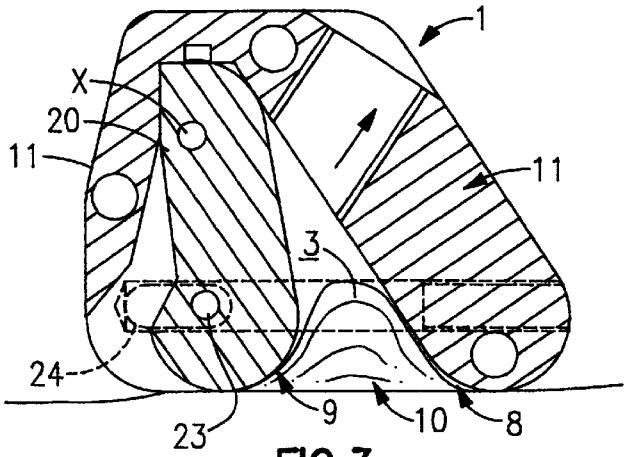
FIGS. 2, 3 and 4 are cross-sectional views on the plane AA in FIG. 1, illustrating the operation of an apparatus of this type.
Figure 2:
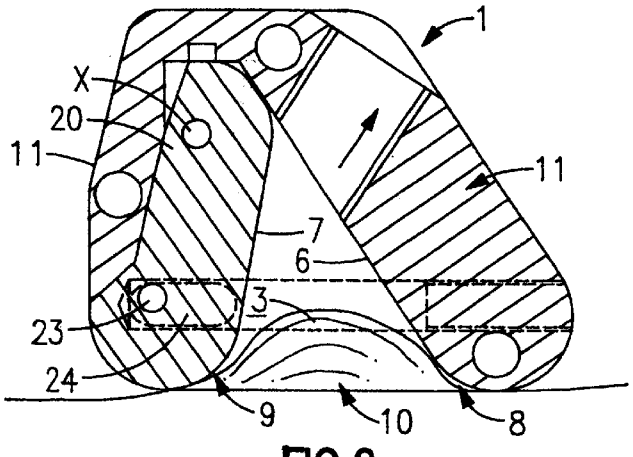
Figure 5:
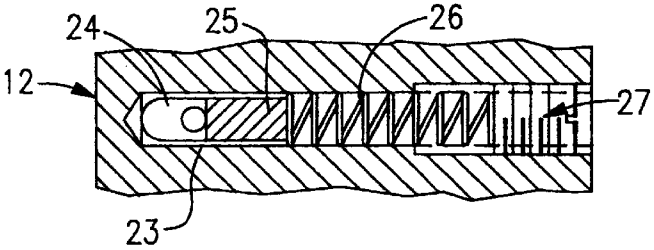
FIG. 5 is a detail showing the structure of thrust means making it possible to keep the two active surfaces normally away from one another.
Figure 4:
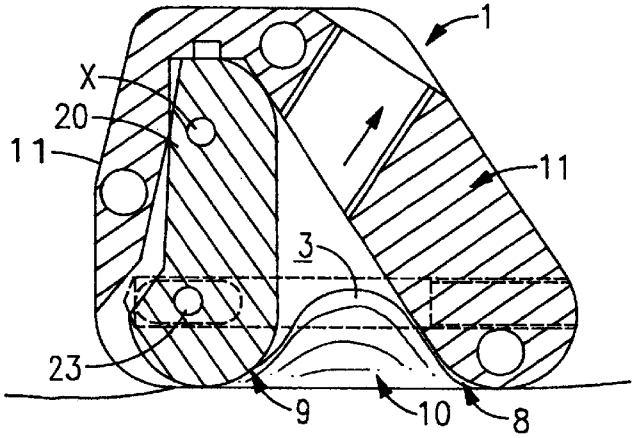

The appended figures represent, substantially at 1:1 scale two massage apparatus produced according to the invention. In the embodiment illustrated by FIGS. 1 to 5, a single one of these active surfaces can be moved to be brought towards or away from the other, whereas in the embodiment illustrated in FIG. 6, both active surfaces can be moved simultaneously towards one another.

In these two embodiments, the massage apparatus according to the invention, which makes it possible to perform treatments combining an action of suction and mobilization of the skin fold, is essentially composed of a treatment head, denoted by the general reference (1), connected by any suitable means, such as a connector (2), to a suction circuits which includes means making it possible to vary the pressure and the air flow rate, which means are, for example, and as indicated above, formed in accordance with the teachings of patent application WO 95/09996, which will not be described in further detail for the sake of simplicity.

The head (1) can be actuated by hand and may, if appropriate, include a handle or have a specific shape so that the operator can hold it directly in his hand.

This head (1) essentially consists of a casing including a central body, including two flanks (11) which define between them a chamber (3) which is open at its base. Two transparent or opaque side flanges (12) are fitted on either side of the central body. These side flanges (12) are fixed to the central body by means of screws denoted by the reference (14), a seal being, if appropriate, provided between the surfaces in contact. The central body (11) and the side flanges (12) define between them a treatment chamber (3) into which a suction circuit (2) opens.

According to the invention, the chamber (3) is open at its base and forms a window delimited, on the one hand, by two side walls (4) consisting of the inner face of the side flanges (12) and, on the other hand, two transverse walls (6,7), the lower edges (8,9) of which constitute the active surfaces of the apparatus, the two walls, or at least one of these walls, can have a movement imparted to it, making it possible to vary the spacing between the active surfaces (8,9) between two predetermined positions. The radius of curvature of the active surfaces (8,9), as well as the spacing between the two lines of tangence with the subject to be treated, will be adapted in accordance with the treatment to be performed and the region of the body to be treated.

By way of example, in the two illustrative embodiments which are shown, the radius of curvature of the active surfaces (8,9) is 10 mm, the maximum spacing between the two lines of tangence with the subject to be treated being of the order of 45 mm, it being possible for the spacing to be reduced to about 30 mm during the movement under the effect of the suction.

In the first embodiment, illustrated by FIGS. 1 to 5, one of the walls, namely the wall (6), consists of the inner face of one of the two flanks (11) of the central body of the casing, the other wall (7) consisting of the inner face of a pivoting partition (20) fitted into the body of the casing. This partition (20) is articulated about a pin (X) arranged in the upper part inside the casing and parallel to the open window. It is held inside the casing by means of two lateral pins (21) which engage inside bearings (22) provided on the side flanges (4). The amplitude of the pivoting inside the chamber is limited between two extreme positions, one (see FIG. 2) according to which the spacing between the two active surfaces (8,9) is a maximum, and the other (FIG. 3) according to which the active surface (9) is brought closer to the active surface (8). The amplitude of the movement is limited by the presence of two fixed stubs (23) which are provided in the lower part of the partition and which can be moved inside two chambers (24) provided in the side flanges (4).

In an embodiment of this type, the pivoting partition (20) is held normally away from the active surface (8). A spacing of this type can be obtained through thrust means which are integrated actually within the side flanges (4) and whose structure can be seen from the detail view in FIG. 5. These thrust means are integrated inside a conduit produced in the side flanges and are accessible from the outside. This conduit opens facing the chambers (24) inside which the stubs (23) can move. A stop (25) bears on each stub (23), which stop is subjected to the action of a spring (26) whose compression ratio can be adjusted by a countersunk screw (27). An adjustment possibility of this type therefore makes it possible to alter at will the movement of the active surface (9) towards the second active surface (8) under the action of the suction.

When an apparatus of this type is used, the skin fold (10) is formed under the action of suction between the two active surfaces (8,9) and, when the operator moves the apparatus, it not only causes the said skin fold (10) to move but also exerts pressure and flexion against the region which is located behind, when considering the direction of movement, the intensity of which flexion depends on the action exerted by the operator. If the suction varies cyclically, an effect of successive take-up and release of the skin fold is obtained, leading to a stimulating and toning massage action under the effect of the pinching action which can be adjusted in intensity and in frequency.

Furthermore, in this embodiment, according to which a single one of the active surfaces can be moved relative to the other, it has been observed that virtually autonomous movement of the said head over the patient's body was also obtained in view of the reciprocating movement which is exerted.

Figure 6:
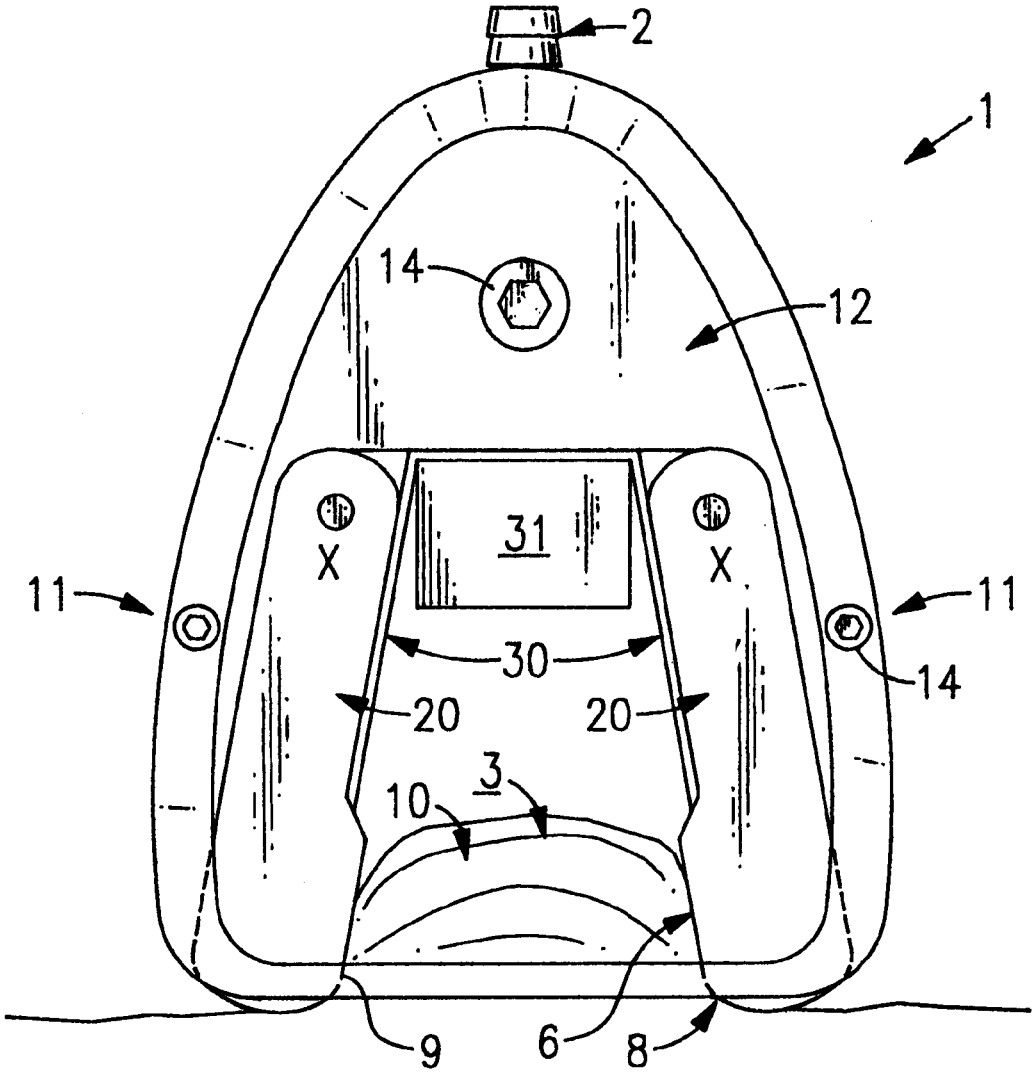
FIGS. 6 and 7 are, respectively, side and exploded perspective views showing the structure of a massage apparatus according to the invention, in which the two active surfaces can be moved towards one another or away from one another at the same time.
Figure 7:
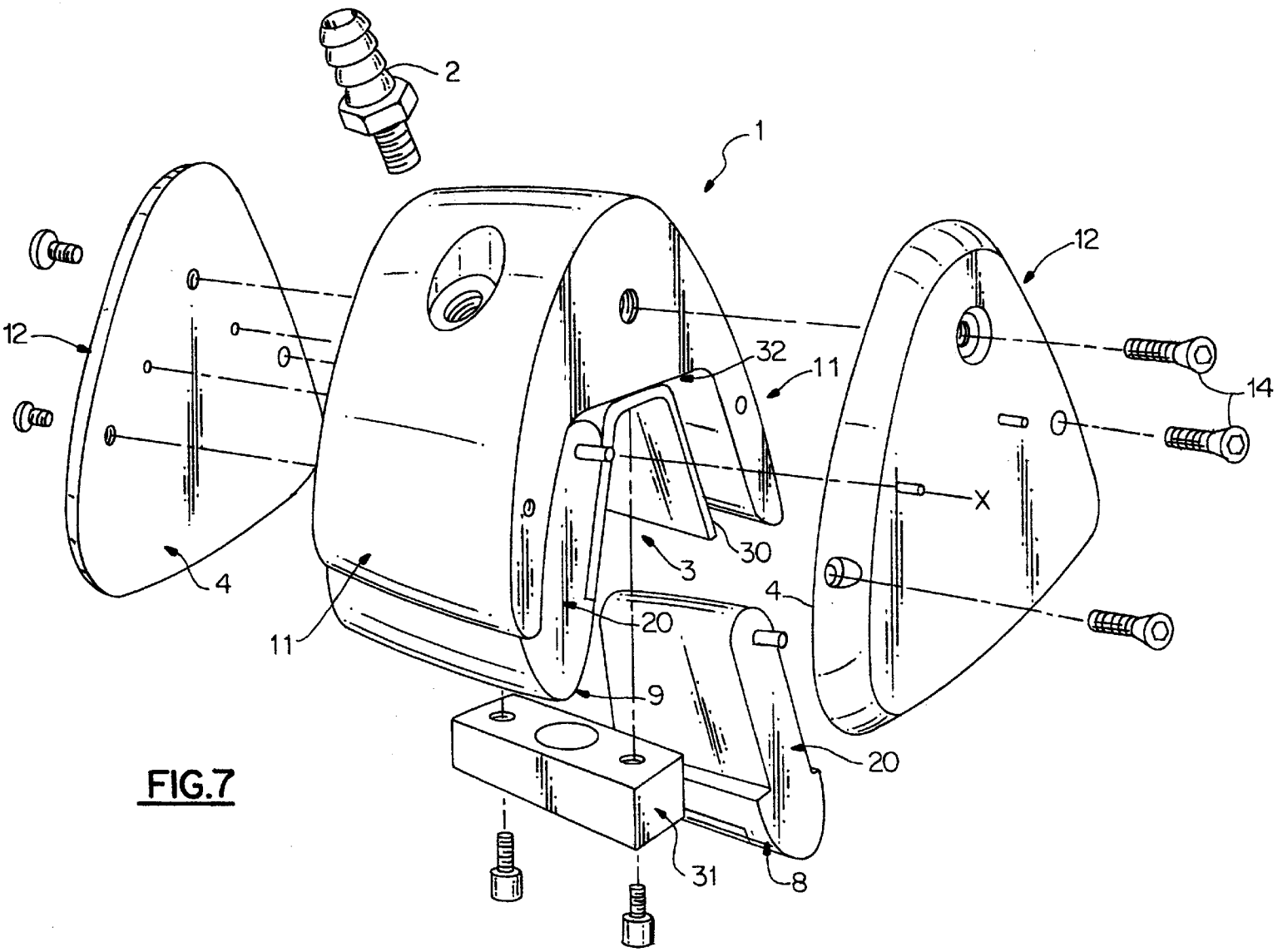

FIGS. 6 and 7 illustrate another embodiment according to the invention, in which the two active surfaces (8,9) can be moved simultaneously.

In this embodiment, the two pivoting partitions (20) are identical and are arranged symmetrically, face to face, between the two flanks (11) of the central body of the casing. The structure and the way in which these two partitions are mounted is similar to the example described above.

In this embodiment, holding in the maximum spacing position, as illustrated in FIG. 6, is obtained under the action of a substantially U-shaped flat spring (30) which bears against the inner surfaces of the walls (11) above the active surfaces. This flat spring (30) is held in simple fashion by means of a block (31) screwed into the end (32) of the chamber (3). The width of this block (31) is such that it limits the amplitude with which the two active surfaces can move towards one another under the effect of the suction.

In comparison with the embodiment according to which a single one of the active surfaces can have a movement imparted to it, a design of this type has the advantage that a treatment can be performed with the same intensity irrespective of the direction of movement of the head against the patient's body.

In the two aforementioned embodiments, it is possible to amplify or communicate natural movement by altering the nature of the materials forming the active surfaces, for example by having one surface with a much lower coefficient of friction than the other surface. Furthermore, although the active surfaces may be made of identical materials, they may, if appropriate, be made of different materials, for example one of the surfaces may be very smooth, having received suitable treatment (for example Teflon), while the other has a higher coefficient of friction and is made, for example, of elastomer.

Lastly, although the two active surfaces may be smooth, it could be envisaged to have active surfaces with protuberances, for example in the form of small spherical portions or the like.

The invention is not, of course, limited to the illustrative embodiments described above, but encompasses all variants made in the same spirit, it being understood that the dimensions of the apparatus could be greater than or less than the concrete examples given above.

I claim:

1. A massage apparatus that includes:

a casing having a pair of opposed side walls and opposed end walls that combine to form a cavity in said casing, an elongated partition mounted in said cavity adjacent one of said end walls that coacts with said other opposed end wall to form a chamber within said cavity having a bottom opening, said partition and said other opposed end wall each having an arcuate shaped bottom edge that extends across the bottom opening of said chamber so that the arcuate shaped edges can move in contact against a patient's skin, suction means that is in communication with said chamber for drawing a patient's skin upwardly into said bottom opening, and pivot means in said partition that is mounted in an upper section of the cavity for pivotally supporting the partition in said cavity so that the partition pivots between a first home position adjacent said one side wall of the casing and a second position to narrow said bottom opening whereby a patient's skin drawn into said opening is pinched between the partition and said opposite end wall.

2. The apparatus of claim 1 that further includes a spring means for urging said partition into said home position.

3. The apparatus of claim 2 wherein one side wall of the casing contains a slotted opening formed therein for housing said spring means in a compressed state and further includes a connector means for coupling the spring means to said partition.

4. The apparatus of claim 3 that further includes an adjustable means for varying the compressive load on said spring means.

5. The apparatus of claim 1 that further includes circuit means for varying the amount of suction applied to said chamber.

6. A massage apparatus that includes a casing having a pair of opposed side walls and a pair of opposed end walls that combine to form a cavity in said casing having a bottom opening, a pair of elongated partitions that are pivotally supported in an upper section of the cavity adjacent to the two end walls of said cavity and extending downwardly into said bottom opening; said partitions being arranged to pivot between a first home position adjacent the end walls of the cavity and a second position to narrow the bottom opening of said cavity, said partitions each having an arcuate shaped bottom edge that extends across the chamber between said side walls so that the edges can move in contact over the skin of a patient, and suction means that is in communication with said chamber so that the partitions move from said home position toward said second position in response to the amount of suction applied to said chamber to capture a fold of a patient's skin between said partitions.

7. The apparatus to claim 6 that further includes a spring means for urging the partitions into said home position.

8. The apparatus of claim 7 wherein said spring means is a U-shaped resilient member mounted in the top of said chamber in an inverted position between the partitions and being arranged to apply a biasing force to each partition.

9. The apparatus of claim 6 wherein the spacing between the partitions at the bottom opening when in the home position is about 45 mm and the spacing between the partitions in at the bottom opening when said second position is about 30 mm.

* * * * *